US008492694B2

(12) United States Patent
Shimoi et al.

(10) Patent No.: US 8,492,694 B2
(45) Date of Patent: Jul. 23, 2013

(54) PHOTOMULTIPLIER TUBE HAVING A PLURALITY OF STAGES OF DYNODES WITH RECESSED SURFACES

(75) Inventors: Hideki Shimoi, Hamamatsu (JP); Hiroyuki Kyushima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 241 days.

(21) Appl. No.: 12/904,650

(22) Filed: Oct. 14, 2010

(65) Prior Publication Data

US 2012/0091316 A1 Apr. 19, 2012

(51) Int. Cl.
*H01J 40/14* (2006.01)

(52) U.S. Cl.
USPC ..... 250/207

(58) Field of Classification Search
USPC ..... 250/207, 214 VT; 313/532–534
See application file for complete search history.

(56) References Cited

U.S. PATENT DOCUMENTS

| | | | | |
|---|---|---|---|---|
| 5,264,693 | A | 11/1993 | Shimabukuro et al. | |
| 5,568,013 | A | 10/1996 | Then et al. | |
| 5,744,908 | A * | 4/1998 | Kyushima | 313/533 |
| 7,049,747 | B1 | 5/2006 | Goodberlet et al. | |
| 7,294,954 | B2 | 11/2007 | Syms | |
| 2006/0220554 | A1 | 10/2006 | Ohmura et al. | |
| 2009/0218944 | A1 | 9/2009 | Kyushima et al. | |
| 2009/0224666 | A1 | 9/2009 | Kyushima et al. | |
| 2009/0283290 | A1 | 11/2009 | Shimoi et al. | |
| 2010/0213837 | A1 | 8/2010 | Shimoi et al. | |
| 2010/0213838 | A1 | 8/2010 | Sugiyama et al. | |

FOREIGN PATENT DOCUMENTS

| | | |
|---|---|---|
| EP | 0 690 478 | 1/1996 |
| JP | H04359855 | 12/1992 |
| JP | 8-17389 | 1/1996 |
| JP | 2007048633 | 2/2007 |
| JP | 2007048712 | 2/2007 |
| JP | 2008293918 | 12/2008 |

OTHER PUBLICATIONS

U.S. Appl. No. 12/904,641, filed Oct. 14, 2010, Shimoi.
"Succeeded in developing the advanced photomultiplier using the world's first MEMS technology for manufacturing semiconductors in an effort to address miniaturization trend and mass production", Sep. 28, 2010, Hamamatsu Photonics K.K. News Release, pp. 1-5 [includes English translation].
"μ PMT—Future PMT from Hamamatsu—", Hamamatsu Photonics K.K., Technical Information, Feb. 2010.

* cited by examiner

*Primary Examiner* — Thanh Luu
*Assistant Examiner* — Renee Naphas
(74) *Attorney, Agent, or Firm* — Drinker Biddle & Reath LLP

(57) ABSTRACT

The photomultiplier tube 1 is provided with an electron multiplying part 33 having a plurality of stages of dynodes 33*a* to 33*l* arrayed along a direction at which electrons are multiplied on an inner surface 40*a* of a casing 5 and a photocathode 41 and an anode part 34 installed so as to be spaced away form the electron multiplying part 33 inside the casing 5. Each of the dynode 33*c* to 33*e* is provided with a plurality of columnar parts 51*c* to 51*e* where secondary electron emitting surfaces 53*c* to 53*e* are formed, thereby forming electron multiplying channels C between adjacent columnar parts. An opposing surface 54*e* which opposes a columnar part 51*d* which is a previous stage at a columnar part 51*e* which is a subsequent stage is formed in such a manner that both end parts 56*e*, 57*e* in a direction along the inner surface 40*a* of the opposing surface 54*e* project to the first end side from a site 55*e* which opposes the end part of the second end side on the secondary electron emitting surface 53*d* of the columnar part 51*d*.

4 Claims, 11 Drawing Sheets

PHOTOMULTIPLIER TUBE HAVING A PLURALITY OF STAGES OF DYNODES WITH RECESSED SURFACES

BACKGROUND OF THE INVENTION

1. Field of the Invention

The present invention relates to a photomultiplier tube for detecting incident light from outside.

2. Related Background Art

Conventionally, compact photomultiplier tubes by utilization of fine processing technology have been developed. For example, a flat surface-type photomultiplier tube which is arranged with a photocathode, dynodes and an anode on a translucent insulating substrate is known (refer to Patent Document 1 given below). The above-described structure makes it possible to detect weak light at a high degree of reliability and also downsize a device. Further, in the photomultiplier tube, there is known a structure in which in order to collect electrons more efficiently between dynodes constituted so as to be stacked in a plurality of stages, each of the dynodes is provided with an accelerating electrode part which projects to a through hole of a dynode which is an upper stage (refer to Patent Document 2 given below).

Patent Document 1: U.S. Pat. No. 5,264,693

Patent Document 2: Japanese Published Unexamined Patent Application No. Hei-8-17389

SUMMARY OF THE INVENTION

However, when the above-described conventional photomultiplier tube is downsized, the photocathode and the electron multiplying part are also made small. Therefore, there is a tendency that a signal amount to be detected is small. As a result, it is necessary to obtain a higher electron multiplying efficiency at the electron multiplying part.

Under these circumstances, the present invention has been made in view of the above problem, an object of which is to provide a photomultiplier tube capable of obtaining a higher electron multiplying efficiency by improving an efficiency of guiding electrons from a dynode which is a previous stage to a dynode which is a subsequent stage, even when downsized.

In order to solve the above problem, the photomultiplier tube of the present invention is provided with a housing having a substrate in which at least an inner surface is formed with an insulating material, an electron multiplying part having N stages (N denotes an integer of two or more) of dynodes arrayed so as to be spaced away sequentially along one direction from a first end side on the inner surface of the housing to a second end side, a photocathode which is installed on the first end side inside the housing so as to be spaced away from the electron multiplying part, converting incident light from outside to photoelectrons to emit the photoelectrons, and an anode part which is installed on the second end side inside the housing so as to be spaced away from the electron multiplying part to take out electrons multiplied by the electron multiplying part as a signal, in which each of the N stages of dynodes is arranged on the inner surface and provided with a plurality of columnar parts where secondary electron emitting surfaces are formed, thereby forming electron multiplying channels having the secondary electron emitting surfaces between adjacent columnar parts among the plurality of columnar parts, and an opposing surface which opposes the columnar part of an $M^{th}$ stage dynode at the columnar part of an $M+1^{th}$ stage (M denotes an integer of one or more but less than N) dynode is formed in such a manner that both end parts of the opposing surface in a direction along the inner surface project to the first end side from a site opposing an end part of the second end side on the secondary electron emitting surface at the columnar part of the $M^{th}$ stage dynode.

According to the above described photomultiplier tube, incident light is made incident onto the photocathode, thereby converted to photoelectrons, and the photoelectrons are multiplied by being made incident into electron multiplying channels formed with a plurality of stages of dynodes on the inner surface inside the housing, and thus multiplied electrons are taken out as an electric signal from the anode part. Here, each of the dynodes is provided with a plurality of columnar parts where secondary electron emitting surfaces in contact with electron multiplying channels are formed, and an opposing surface which is in a previous stage side at a columnar part of a dynode which is a subsequent stage is formed in such a manner that both end parts along the inner surface of a substrate project from the center of a site which opposes an end part which is in a subsequent stage side on the secondary electron emitting surface of a dynode which is a previous stage. Therefore, it is possible to increase a potential in the vicinity of the secondary electron emitting surface inside the electron multiplying channel of a dynode which is a previous stage and also efficiently guide multiplied electrons from a dynode which is a previous stage to a dynode which is a subsequent stage. As a result, it is possible to obtain a high electron multiplying efficiency.

It is preferable that an opposing surface which opposes the columnar part of the $M+1^{th}$ stage dynode at the columnar part of the $M^{th}$ stage dynode is formed in such a manner that a site opposing the end part of the $M+1^{th}$ stage dynode is recessed to the first end side. In this instance, an electric field pushed out by an opposing surface in a previous stage side at a dynode which is a subsequent stage is easily drawn into a dynode which is a previous stage, by which a potential inside the electron multiplying channel rises, thus making it possible to increase an electron multiplying efficiency.

It is also preferable that each of the N stages of dynodes are provided with a base part which is formed at end parts on the inner surface side at the plurality of columnar parts to electrically connect the plurality of columnar parts, and the base part of the $M^{th}$ stage dynode is formed at a site corresponding to the end part of the columnar part of the $M+1^{th}$ stage dynode so as to be recessed to the first end side. When the above-described constitution is adopted, it is possible to improve the withstand voltage properties between adjacent stages of dynodes and therefore bring the dynodes closer to each other. As a result, multiplied electrons can be efficiently guided from a dynode which is a previous stage to a dynode which is a subsequent stage, thus making it possible to further increase the electron multiplying efficiency.

Further, it is preferable that the anode part is provided with an electron trapping part which is formed in such a manner as to be recessed to the second end side opposite to the electron multiplying channel of the $N^{th}$ stage dynode. The electron trapping part is able to efficiently trap multiplied electrons from the $N^{th}$ stage dynode.

DESCRIPTION OF THE PREFERRED EMBODIMENTS

Figure 1:
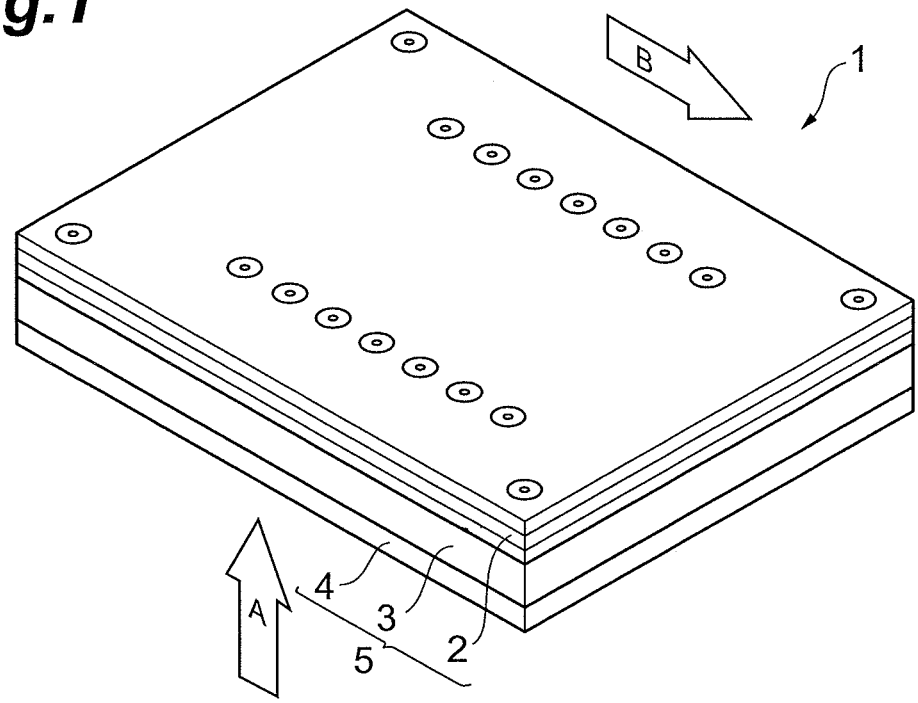
FIG. 1 is a perspective view of a photomultiplier tube which is related to one preferred embodiment of the present invention.

Hereinafter, a detailed description will be given for preferred embodiments of the photomultiplier tube related to the present invention by referring to drawings. In addition, in describing the drawings, the same or corresponding parts will be given the same reference numerals to omit overlapping description.

Figure 2:
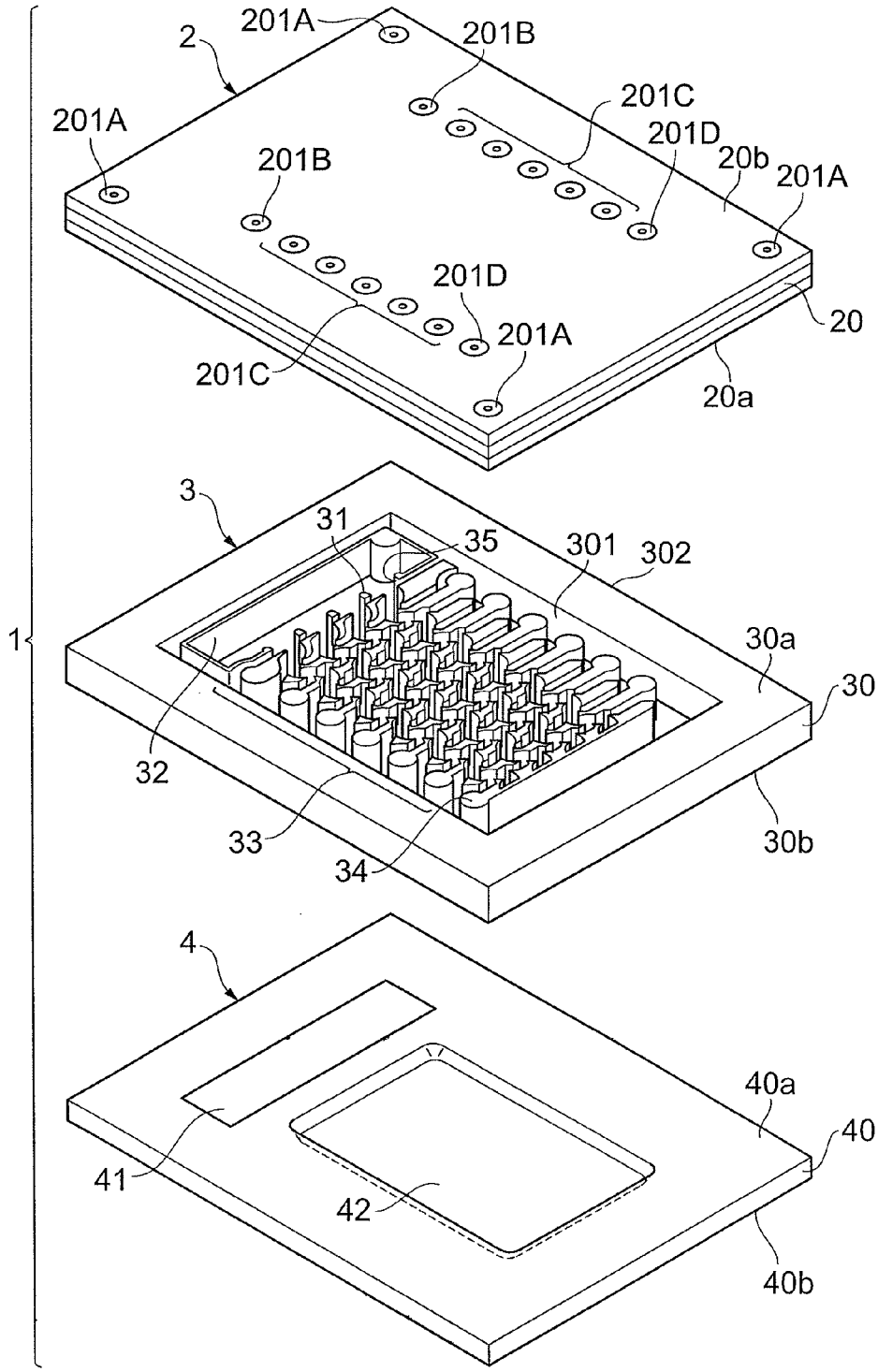
FIG. 2 is an exploded perspective view of the photomultiplier tube shown in FIG. 1.

FIG. 1 is a perspective view of a photomultiplier tube 1 related to one preferred embodiment of the present invention. FIG. 2 is an exploded perspective view of the photomultiplier tube 1 shown in FIG. 1.

The photomultiplier tube 1 shown in FIG. 1 is a photomultiplier tube having a transmission-type photocathode and provided with a casing 5, that is, a housing constituted with an upper frame 2, a side wall frame 3, and a lower frame (a substrate) 4 which opposes the upper frame 2, with the side wall frame 3 kept therebetween. The photomultiplier tube 1 is an electron tube such that when light is made incident from a direction at which a light incident direction onto the photocathode intersects with a direction at which electrons are multiplied at electron multiplying parts, that is, a direction indicated by the arrow A in FIG. 1, photoelectrons emitted from the photocathode are made incident onto the electron multiplying parts, thereby secondary electrons are subjected to cascade amplification in a direction indicated by the arrow B to take out a signal from the anode part.

It is noted that in the following description, the upstream side of an electron multiplying channel (the side of the photocathode) along a direction at which electrons are multiplied is given as "a first end side," while the downstream side (the side of the anode part) is given as "a second end side." Further, a detailed description will be given for individual constituents of the photomultiplier tube 1.

As shown in FIG. 2, the upper frame 2 is constituted with a wiring substrate 20 made mainly with rectangular flat-plate like insulating ceramics as a base material. As the above-described wiring substrate, there is used a multilayer wiring substrate such as LTCC (low temperature co-fired ceramics) in which microscopic wiring can be designed and also wiring patterns on front-back both sides can be freely designed. The wiring substrate 20 is provided on a main surface 20*b* thereof with a plurality of conductive terminals 201A to 201D electrically connected to the side wall frame 3, a photocathode 41, focusing electrodes 31, a wall-like electrode 32, electron multiplying parts 33, and the anode part 34 which are described later, to supply power from outside and take out a signal. The conductive terminal 201A is installed for supplying power to the side wall frame 3, the conductive terminal 201B for supplying power to the photocathode 41, the focusing electrodes 31 and the wall-like electrode 32, the conductive terminal 201C for supplying power to the electron multiplying parts 33, and the conductive terminal 201D for supplying power to the anode part 34 and taking out a signal respectively. These conductive terminals 201A to 201D are mutually connected to conductive layers and the conductive terminals (details will be described later) on an insulating opposing surface 20*a* which opposes the main surface 20*b* inside the wiring substrate 20, by which these conductive layers and the conductive terminals are connected to the side wall frame 3, the photocathode 41, the focusing electrodes 31, the wall-like electrode 32, the electron multiplying parts 33 and the anode part 34. Further, the upper frame 2 is not limited to a multilayer wiring substrate having the conductive terminals 201 but may include a plate-like member made with an insulating material such as a glass substrate on which conductive terminals for supplying power from outside and taking out a signal are installed so as to penetrate.

The side-wall frame 3 is constituted with a rectangular flat-plate like silicon substrate 30 as a base material. A penetration part 301 enclosed by a frame-like side wall part 302 is formed from a main surface 30*a* of the silicon substrate 30 toward an opposing surface 30*b* thereto. The penetration part 301 is provided with a rectangular opening and an outer periphery of which is formed so as to run along the outer periphery of the silicon substrate 30.

Inside the penetration part 301, the wall-like electrode 32, the focusing electrodes 31, the electron multiplying parts 33 and the anode part 34 are arranged from the first end side to the second end side. The wall-like electrode 32, the focusing electrodes 31, the electron multiplying parts 33 and the anode part 34 are formed by processing the silicon substrate 30 according to RIE (Reactive Ion Etching) processing, etc., and mainly made with silicon.

The wall-like electrode 32 is a frame-like electrode which is formed so as to enclose a photocathode 41 to be described later when viewed from a direction completely opposite to an opposing surface 40*a* of the glass substrate 40 to be described later (a direction approximately perpendicular to the opposing surface 40*a* and a direction opposite to a direction indicated by the arrow A of FIG. 1). Further, the focusing electrode 31 is an electrode for focusing photoelectrons emitted from the photocathode 41 and guiding them to the electron multiplying parts 33 and installed between the photocathode 41 and the electron multiplying parts 33.

The electron multiplying parts 33 are constituted with N stages (N denotes an integer of two or more) of dynodes (an electron multiplying part) set so as to be different in potential along a direction at which electrons are multiplied from the photocathode 41 to the anode part 34 (in a direction indicated by the arrow B of FIG. 1 and the same shall be applied hereinafter) and provided with a plurality of electron multiplying channels (electron multiplying channels) so as to be astride individual stages. Further, the anode part 34 is arranged at a position holding the electron multiplying parts 33 together with the photocathode 41.

The wall-like electrode 32, the focusing electrodes 31, the electron multiplying parts 33 and the anode part 34 are individually fixed to the lower frame 4 by anode bonding, diffusion joining and joining, etc., using a sealing material such as a low-melting-point metal (for example, indium), by which they are arranged on the lower frame 4 two-dimensionally.

The lower frame 4 is constituted with the rectangular flat-plate like glass substrate 40 as a base material. The glass substrate 40 forms an opposing surface 40*a*, that is, an inner surface of the casing 5, which opposes the opposing surface 20*a* of the wiring substrate 20, by use of glass which is an insulating material. The photocathode 41 which is a transmission-type photocathode is formed at a site opposing a penetration part 301 of the side wall frame 3 on the opposing surface 40*a* (a site other than a joining region with a side wall part 302) and at the end part opposite to the side of the anode part 34. Further, a rectangular recessed part 42 which prevents multiplied electrons from being made incident onto the opposing surface 40*a* is formed at a site where the electron multiplying parts 33 and the anode part 34 on the opposing surface 40*a* are loaded.

Figure 3:
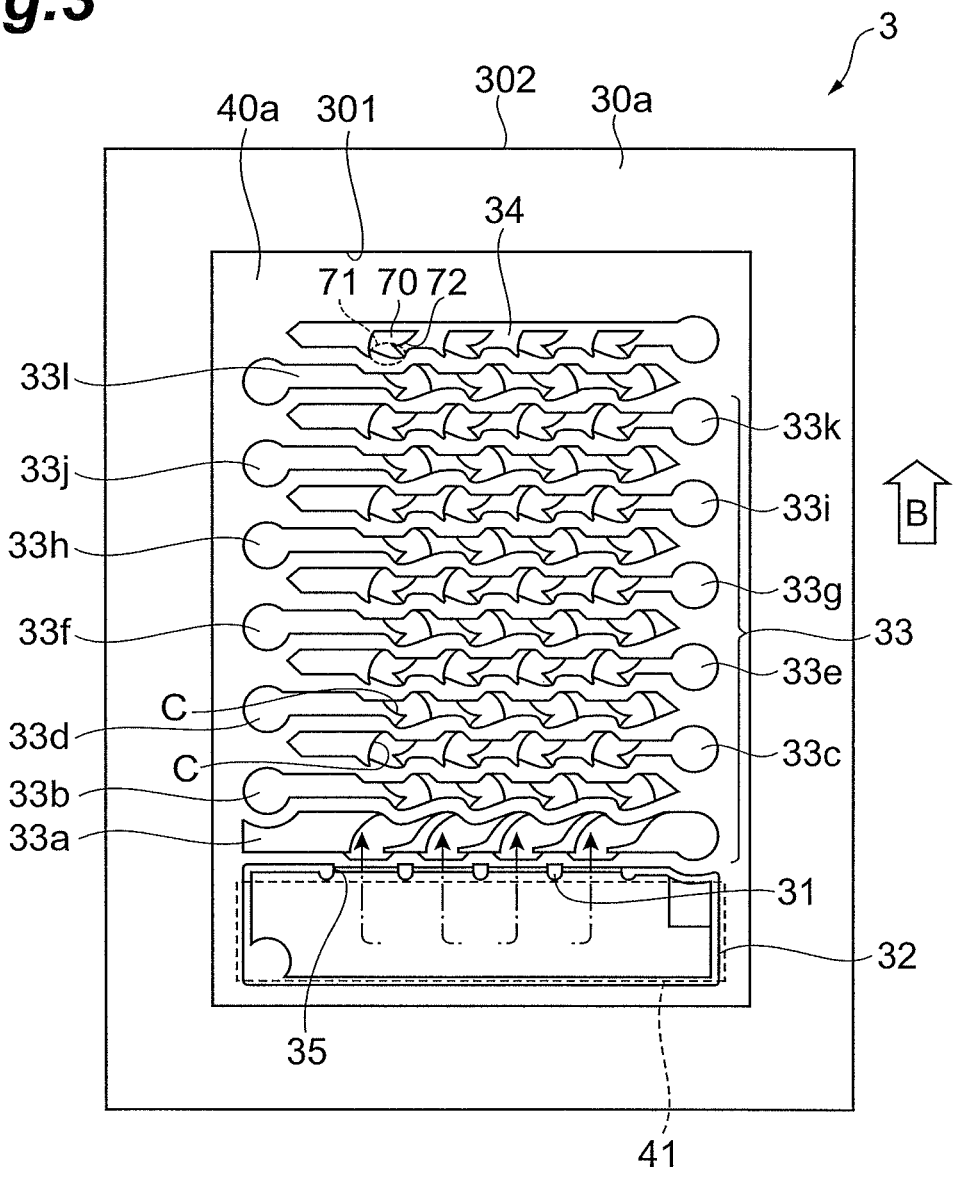
FIG. 3 is a plan view which shows a side wall frame of FIG. 1.
Figure 4:
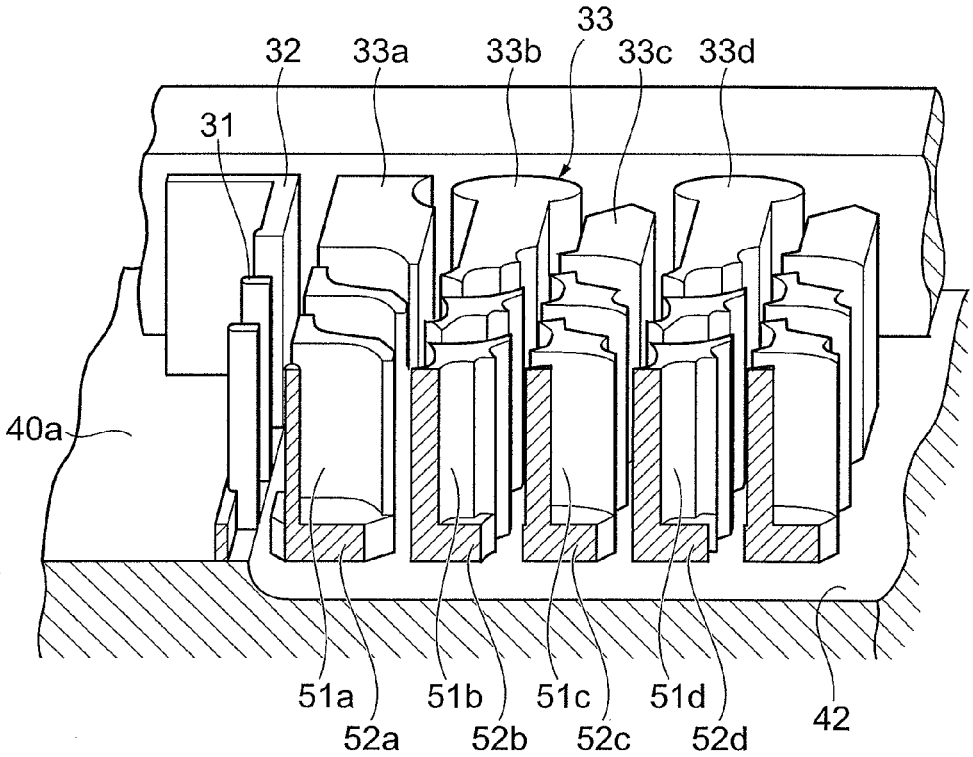
FIG. 4 is a partially broken perspective view which shows major parts of the side wall frame and a lower frame of FIG. 1.
Figure 5:
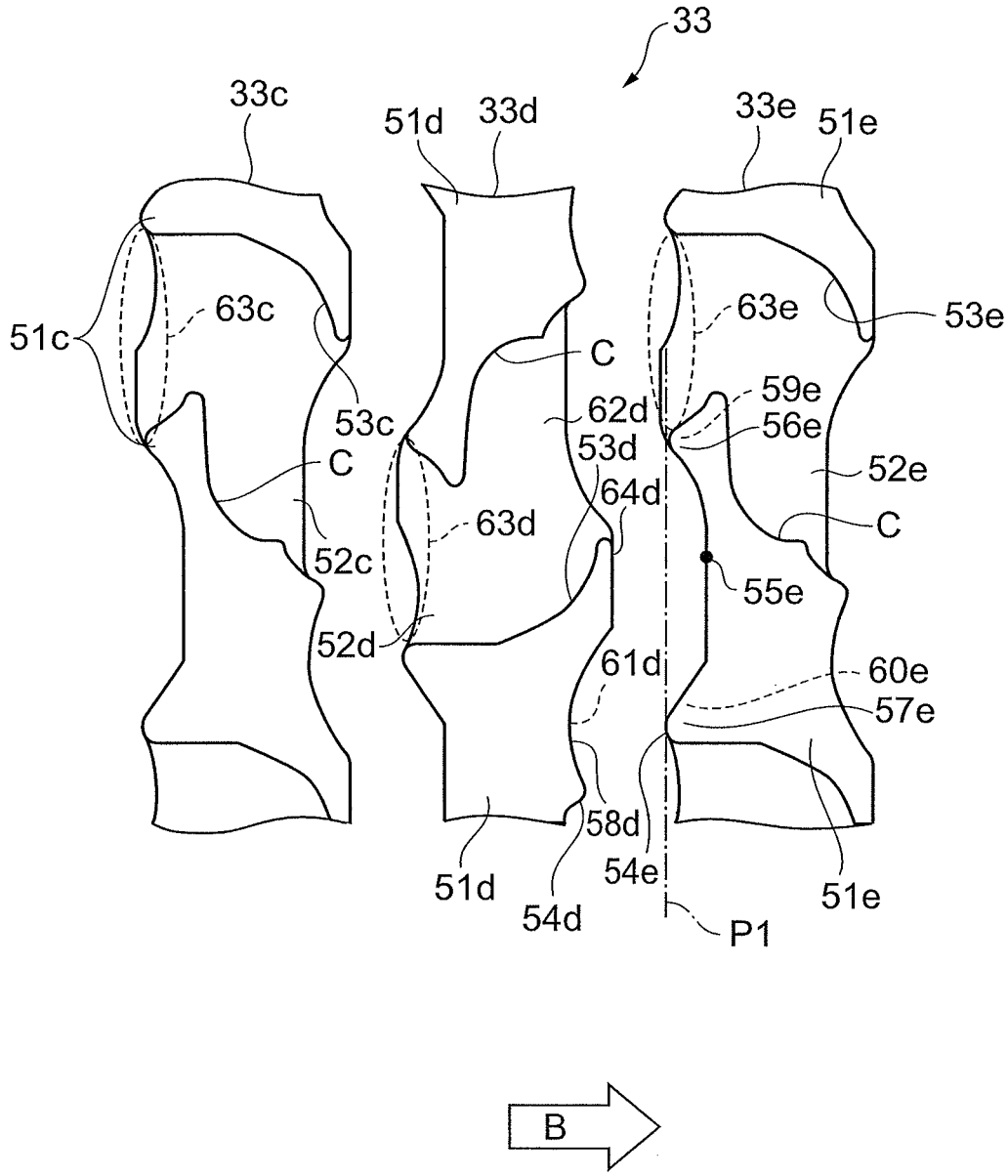
FIG. 5 is a plan view which partially enlarges an electron multiplying part of FIG. 3.

A detailed description will be given for an internal structure of the photomultiplier tube 1 by referring to FIG. 3 to FIG. 5. FIG. 3 is a plan view which shows the side wall frame 3 of FIG. 1. FIG. 4 is a partially broken perspective view which shows major parts of the side wall frame 3 and the lower frame 4 of FIG. 1. FIG. 5 is a plan view which enlarges the electron multiplying parts 33 of FIG. 3.

As shown in FIG. 3, the electron multiplying parts 33 inside the penetration part 301 are constituted with a plurality of stages of dynodes 33*a* to 33*l* arrayed so as to be spaced away sequentially from the first end side on the opposing surface 40*a* to the second end side (in a direction indicated by the arrow B, that is, a direction at which electrons are multiplied). The plurality of stages of dynodes 33*a* to 33*l* form in parallel a plurality of electron multiplying channels C constituted with the N number of electron multiplying holes installed so as to continue along a direction indicated by the arrow B from a $1^{st}$ stage dynode 33*a* on the first end side to a final stage (an $N^{th}$ stage) dynode 33*l* on the second end side.

Further, the photocathode 41 is installed so as to be spaced away from the $1^{st}$ stage dynode 33*a* on the first end side to the first end side on the opposing surface 40*a* behind the focusing electrodes 31. The photocathode 41 is formed on the opposing surface 40*a* of the glass substrate 40 as a rectangular transmission-type photocathode. When incident light transmitted from outside through the glass substrate 40, which is the lower frame 4, arrives at the photocathode 41, photoelectrons corresponding to the incident light are emitted, and the photoelectrons are guided into the $1^{st}$ stage dynode 33*a* by the wall-like electrode 32 and the focusing electrodes 31.

Further, the anode part 34 is installed so as to be spaced away from the final stage dynode 33*l* on the second end side to the second end side on the opposing surface 40*a*. The anode part 34 is an electrode for taking outside electrons which are multiplied in a direction indicated by the arrow B inside the electron multiplying channels C of the electron multiplying parts 33 as an electric signal. Still further, the anode part 34 is provided with an electron trapping part 70 formed so as to be recessed from an opposing surface which opposes the dynode 33*l* to the second end side of the opposing surface 40*a* in such a manner as to oppose the electron multiplying channel C of the final stage dynode 33*l*. The electron trapping part 70 has a protruding part 72 which narrows an electron incident opening 71 on the same side as the secondary electron emitting surface of the dynode 33*l*.

A more detailed description will be given for a structure of the electron multiplying part 33 by referring to FIG. 4 and FIG. 5. A plurality of stages of dynodes 33*a* to 33*d* are arranged over the bottom of a recessed part 42 formed on the opposing surface 40*a* of the lower frame 4 so as to be spaced away from the bottom of the recessed part 42. The dynode 33*a* is arrayed along the opposing surface 40*a* in a direction substantially perpendicular to a direction at which electrons are multiplied and made up with a plurality of columnar parts 51*a* extending in a substantially perpendicular direction toward the opposing surface 20*a* of the upper frame 2 and a base part 52*a* formed continuously at the end parts of the plurality of columnar parts 51*a* on the recessed part 42 and extending along the bottom of the recessed part 42 in a substantially perpendicular direction with respect to a direction at which electrons are multiplied. This base part 52*a* functions to electrically connect between the plurality of columnar parts 51*a*, and also functions to retain the plurality of columnar parts 51*a* so as to be spaced away from the bottom of the recessed part 42. The dynodes 33*b* to 33*d* are also similar in structure to the dynode 33*a* respectively with regard to a plurality of columnar parts 51*b* to 51*d* and base parts 52*b* to 52*d*. It is noted that in the present embodiment, in the dynodes 33*a* to 33*d*, the plurality of columnar parts 51*a* to 51*d* and the base parts 52*a* to 52*d* are individually formed in an integrated manner but the columnar parts may be separated from the base parts. Further, although not illustrated, the dynodes 33*e* to 33*l* are similar in structure.

Electron multiplying channels for subjecting secondary electrons to cascade amplification in association with photoelectrons which are made incident are formed by the plurality of columnar parts 51*a* to 51*d* belonging to the plurality of stages of dynodes 33*a* to 33*d*. For the sake of convenience, a more detailed description will be given by extracting one electron multiplying channel C from those of the dynodes 33*c* to 33*e*. That is, as shown in FIG. 5, the electron multiplying channel C is formed between columnar parts adjacent in a direction perpendicular to a direction at which electrons are multiplied, among the plurality of columnar parts 51*c* to 51*e* of the respective dynodes 33*c* to 33*e*. The electron multiplying channels C are formed by the plurality of stages of dynodes 33*c* to 33*e* so as to meander toward a direction at which electrons are multiplied. Further, secondary electron emitting surfaces 53*c*, 53*d*, 53*e* are formed at one ends formed approximately in a circular arc shape so as to face to electron incident openings 63*c*, 63*d*, 63*e*, among wall surfaces in contact with the electron multiplying channels C of the respective columnar parts 51*c*, 51*d*, 51*e*. It is noted that the electron multiplying channels C are installed perpendicularly side by side in a plural number between all the dynodes 33*a* to 33*l* in a direction at which electrons are multiplied.

Here, an opposing surface 54*e* which opposes the columnar part 51*d* of the dynode 33*d* which is a previous stage at the columnar part 51*e* of the dynode 33*e* which is a subsequent stage is formed in the following shape. More specifically, the opposing surface 54*e* is formed in such a shape that both end parts 56*e*, 57*e* in a direction along the opposing surface 40*a* project in a direction opposite to a direction at which electrons are multiplied (the first end side or a direction opposite to the direction indicated by the arrow B), from a site 55*e* which opposes an end part 64*d* in a direction at which electrons are multiplied (on the second end) side on the secondary electron emitting surface 53*d* of the dynode 33*d* which is a previous stage. In other words, the opposing surface 54*e* is formed in such a shape that the shape of the cross section including the site 55*e* along the opposing surface 40*a* is recessed in a direction at which electrons are multiplied on the basis of a plain surface P1 passing through the end parts 56*e*, 57*e* perpendicular to a direction at which electrons are multiplied. Further, the opposing surface 54*e* is formed approximately in a smooth circular arc shape so as to be recessed to the second end side both from the end part 56*e* to the site 55*e* and from the end part 57*e* to the site 55*e* when viewed from a direction completely opposite to the opposing surface 40*a* of the lower frame 4, thereby formed approximately in a smooth circular arc shape so as to be recessed to the second end side as a whole. Still further, the opposing surface 54*d* which opposes the columnar part 51*e* of the dynode 33*e* which is a subsequent stage at the columnar part 51*d* of the dynode 33*d* which is a previous stage is formed in a shape corresponding to the columnar part 51*e*. That is, the opposing surface 54*d* is formed in such a manner that a site 58*d* opposing the end part 57*e* of the opposing surface 54*e* is recessed in a direction (the first end side) opposite to a direction at which electrons are multiplied. At a region where the opposing surface 54*d* of the columnar part 51*d* faces to the opposing surface 54*e* of the columnar part 51*e*, an interval between both of the surfaces in a direction at which electrons are multiplied is made substantially uniform.

Further, the base parts 52*d*, 52*e* are formed in such a shape that corresponds to the shapes of the above-described columnar parts 51*d*, 51*e*. More specifically, sites 59*e*, 60*e* corresponding to both of the end parts 56*e*, 57*e* of the columnar part 51*e* are formed at the base part 52*e* in such a shape so as to project in a direction opposite to a direction at which electrons are multiplied. Still further, a site 61*d* corresponding to the site 58*d* of the columnar part 51*d* is formed at the base part 52*d* in such a shape as to be recessed in a direction opposite to a direction at which electrons are multiplied. In addition, a site 62*d* opposing the site 59*e* of the base part 52*e* is formed at the base part 52*d* in such a shape as to be recessed in a direction opposite to a direction at which electrons are multiplied. That is, at the base parts 52*d*, 52*e* as well, an interval between them in a direction at which electrons are multiplied is made substantially uniform.

It is noted that in the plurality of stages of dynodes 33*a* to 33*l*, an opposing surface between an adjacent $M^{th}$ stage dynode and an $M+1^{th}$ stage ($1 \leqq M < 12$) dynode is formed in a shape similar to the above-described shape. Further, the respective opposing surfaces between the final stage dynode 33*l* and the anode part 34 are also formed in a shape similar to the above-described shape.

Figure 6:
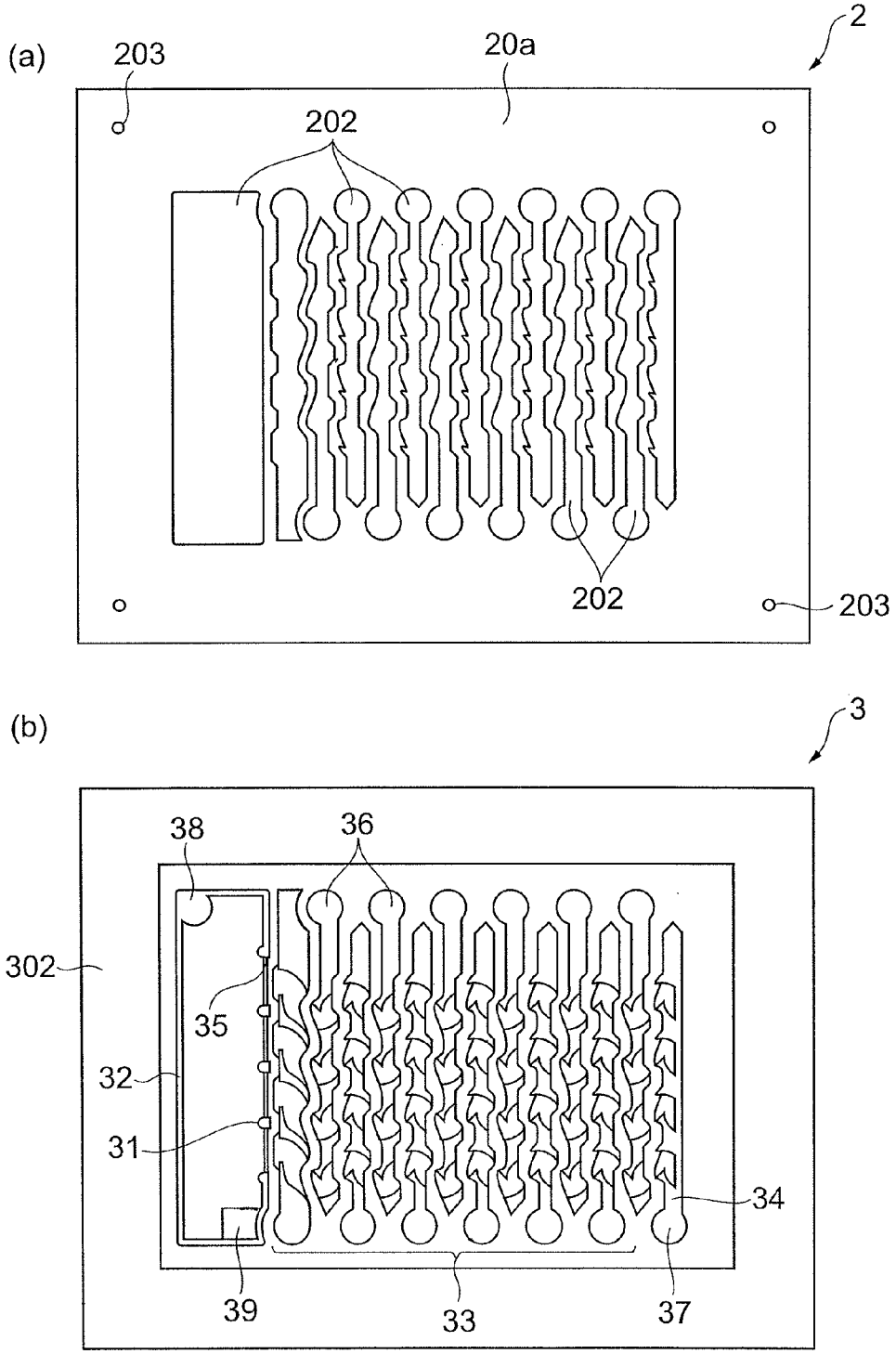
FIG. 6 (*a*) is a bottom view of an upper frame of FIG. 1 when viewed from the back, and FIG. 6 (*b*) is a plan view of the side wall frame of FIG. 1.
Figure 7:
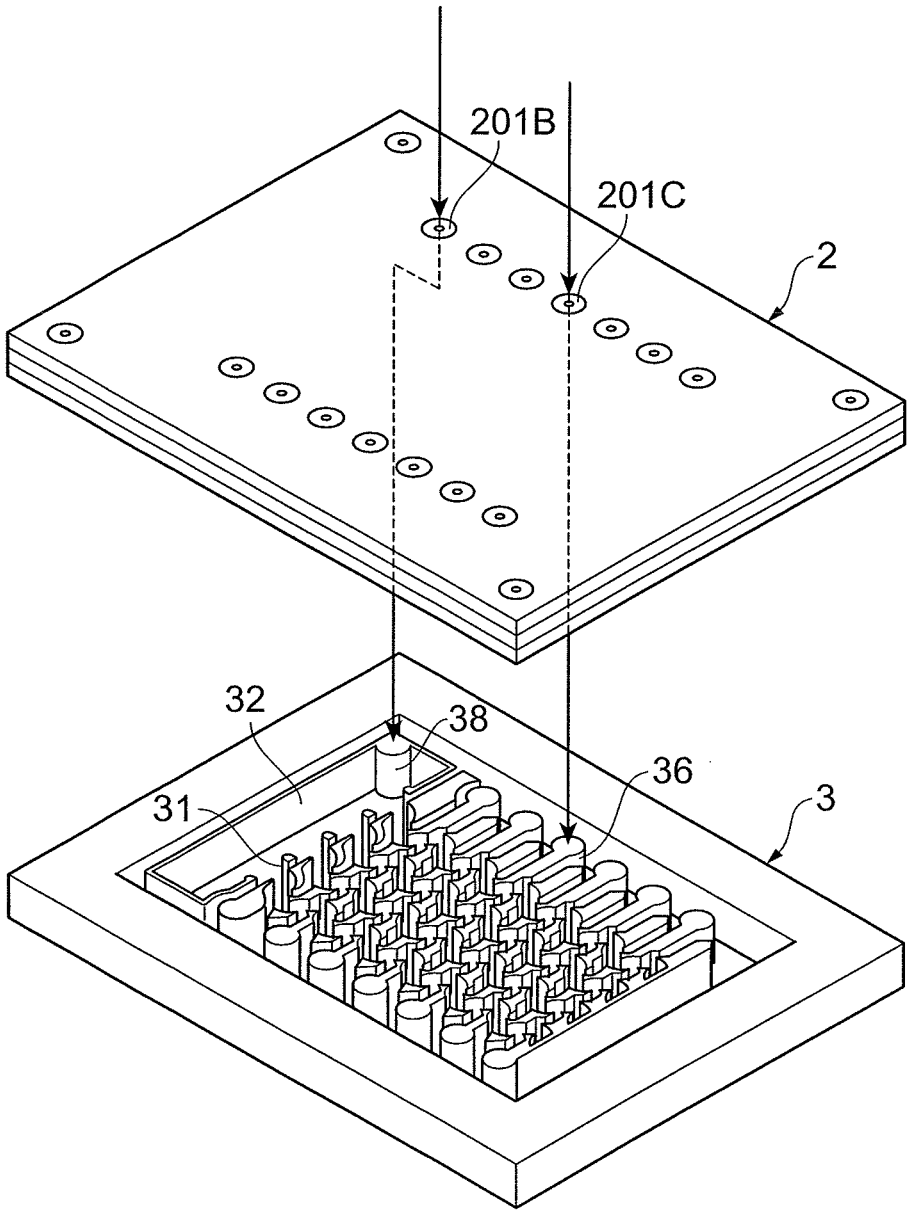
FIG. 7 is a perspective view showing a state which connects the upper frame to the side wall frame as shown in FIG. 6.

Next, a description will be given for a wiring structure of the photomultiplier tube 1 by referring to FIG. 6 and FIG. 7. In FIG. 6, (a) is a bottom view when the upper frame 2 is viewed from the side of a back surface 20*a*, and (b) is a plan view of the side wall frame 3. FIG. 7 is a perspective view which shows a state connecting the upper frame 2 with the side wall frame 3.

As shown in FIG. 6(*a*), the back surface 20*a* of the upper frame 2 is provided with a plurality of conductive layers 202 electrically connected to the respective conductive terminals 201B, 201C, 201D inside the upper frame 2, and a conductive terminal 203 electrically connected to the conductive terminal 201A inside the upper frame 2. Further, as shown in FIG. 6(*b*), power supplying parts 36, 37 for connecting to the conductive layers 202 are installed upright respectively at the end parts of the electron multiplying parts 33 and the anode part 34, and a power supplying part 38 for connecting to the conductive layers 202 is installed upright at a corner of the wall-like electrode 32. Still further, the focusing electrodes 31 are formed integrally with the wall-like electrode 32 on the side of the lower frame 4, thereby electrically connected to the wall-like electrode 32. In addition, a rectangular flat-plate like connecting part 39 is formed integrally at the wall-like electrode 32 on the side of the opposing surface 40*a* of the lower frame 4. A conductive layer (not illustrated) formed electrically in contact with the photocathode 41 on the opposing surface 40*a* is joined to the connecting part 39, by which the wall-like electrode 32 is electrically connected to the photocathode 41.

The above constituted upper frame 2 and the side wall frame 3 are joined, by which the conductive terminal 203 is electrically connected to the side wall part 302 of the side wall frame 3. Also, the power supplying part 36 of the electron multiplying part 33, the power supplying part 37 of the anode part 34 and the power supplying part 38 of the wall-like electrode 32 are respectively connected to the corresponding conductive layers 202 independently via conductive members made with gold (Au), etc. The above-described connecting structure makes it possible to electrically connect the side wall part 302, the electron multiplying part 33 and the anode part 34 respectively to the conductive terminals 201A, 201C, 201D. Also, the wall-like electrode 32 is electrically connected to the conductive terminal 201B together with the focusing electrodes 31 and the photocathode 41 (FIG. 7).

According to the photomultiplier tube 1 which has been so far described, incident light is made incident onto the photocathode 41, thereby converted to photoelectrons, and the photoelectrons are multiplied by being made incident into electron multiplying channels C formed with a plurality of stages of dynodes 33*a* to 33*l* on the inner surface 40*a* inside the casing 5, and thus multiplied electrons are taken out as an electric signal from the anode part 34. Here, each of the dynodes 33*a* to 33*e* is provided with a plurality of columnar parts 51*a* to 51*e* where secondary electron emitting surfaces which constitute electron multiplying channels C are formed. The opposing surface 54*e* in a previous stage side at the columnar part 51*e* of the dynode 33*e* which is a subsequent stage is formed in such a manner that both end parts 56*e*, 57*e* along the inner surface 40*a* of the lower frame 4 project from the site 55*e* opposing the end part in a subsequent stage side on the secondary electron emitting surface 53*d* of the columnar part 51*d* which is a previous stage. Therefore, a potential of the dynode 33*e* which is a subsequent stage is allowed to permeate into the electron multiplying channel C of the dynode 33*d* which is a previous stage, thus making it possible to increase a potential in the vicinity of the secondary electron emitting surface 53*d* and also efficiently guide multiplied electrons from the dynode 33*d* which is a previous stage to the dynode 33*e* which is a subsequent stage. Further, a part opposing the dynode 33*e* which is a subsequent stage at the dynode 33*d* which is a previous stage is formed in such a manner that the site 61*d* opposing the end part 57*e* of the dynode 33*e* is recessed. Therefore, an electric field pushed out by the opposing surface 54*e* in a previous stage side at the dynode 33*e* which is a subsequent stage is easily drawn into the side of the dynode 33*d* without being prevented by a potential applied to the dynode 33*d* which is a previous stage. Then, a potential inside the electron multiplying channel C is elevated, thus making it possible to further increase an electron multiplying efficiency. As a result, it is possible to obtain a high electron multiplying efficiency even if the electron multiplying part 33 is downsized.

Further, since the base part 52*d* of the dynode 33*d* which is a previous stage is formed so as to be recessed to the first end side at the site 62*d* corresponding to the end part 56*e* at the columnar part 51*e* of the dynode 33*e* which is a subsequent stage, it is possible to improve the withstand voltage properties between adjacent dynodes 33*d*, 33*e*. Thereby, the dynodes 33*d*, 33*e* are allowed to be brought closer. As a result, multiplied electrons can be efficiently guided from the dynode 33*d* which is a previous stage to the dynode 33*e* which is a subsequent stage, thus making it possible to further increase the electron multiplying efficiency. At the adjacent dynodes

33*d*, 33*e* as well, an interval between them in a direction at which electrons are multiplied can be made substantially uniform. Therefore, it is possible to further improve the withstand voltage properties and also improve the reproducibility of the shape by removing variance in the shape on processing by RIE processing, etc.

Still further, the anode part 34 is provided with an electron trapping part 70 formed so as to be recessed from an opposing surface which opposes the dynode 33*l* to the second end side of the opposing surface 40*a* in such a manner as to oppose the electron multiplying channel of the final stage dynode 33*l*. It is, therefore, possible to efficiently trap multiplied electrons from the final stage dynode 33*l* by the electron trapping part 70 formed so as to be recessed. The electron trapping part 70 is also provided on the same side as the secondary electron emitting surface of the dynode 33*l* with a protruding part 72 which narrows the electron incident opening 71. Then, such a state is provided that confines the multiplied electrons guided into the electron trapping part 70, by which the multiplied electrons can be utilized as a detection signal more reliably. Further, on the respective opposing surfaces between the final stage dynode 33*l* and the anode part 34 as well, there is formed a shape similar to the opposing surface between the above-described adjacent dynodes. It is, therefore, possible to form an electric field that will efficiently guide electrons from the final stage dynode 33*l* to the electron trapping part 70 of the anode part 34.

Figure 8:
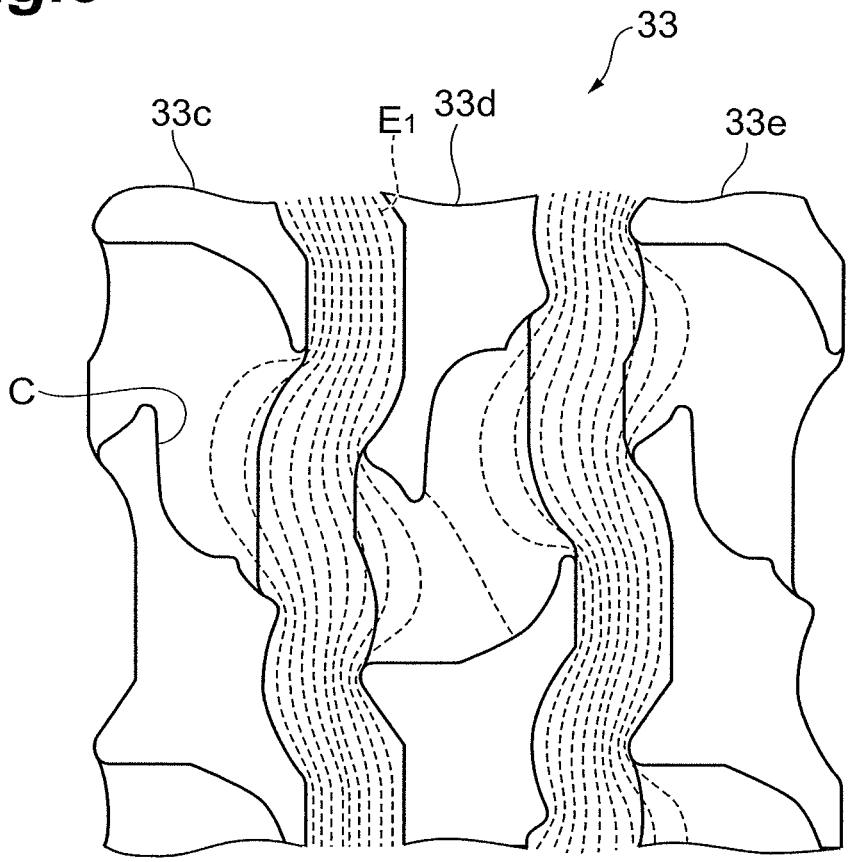
FIG. 8 is a view which shows a potential distribution generated by the electron multiplying part of FIG. 5.
Figure 11:
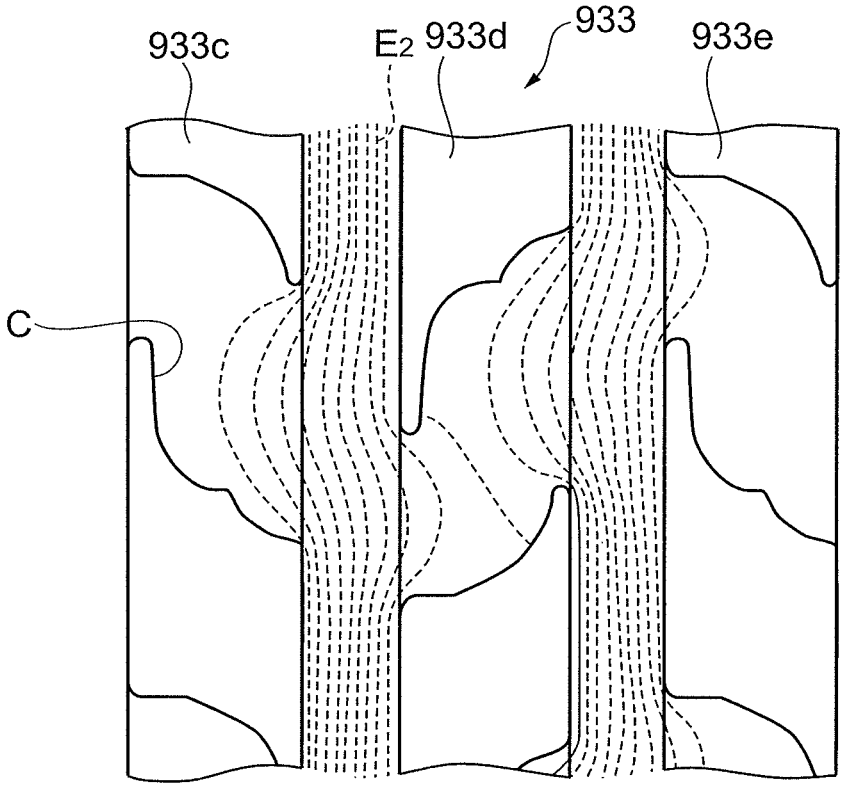
FIG. 11 is a view which shows a potential distribution at an electron multiplying part of a comparative example of the present invention.

FIG. 8 is a view which shows a potential distribution when viewed from a direction along the opposing surface 40*a* at the electron multiplying part 33 of the present embodiment. FIG. 11 is a view which shows a potential distribution when viewed from a direction along the opposing surface 40*a* at an electron multiplying part 933 which is a comparative example of the present invention. Here, the electron multiplying part 933 is assumed to have a plain surface shape in which the respective opposing surfaces of dynodes 933*c* to 933*e* are provided along a plain surface perpendicular to a direction at which electrons are multiplied. As described above, it is found that a potential $E_1$ generated by the electron multiplying part 33 has penetrated more deeply into the first end side inside the electron multiplying channel C than a potential $E_2$ generated by the electron multiplying part 933, and a potential near the secondary electron emitting surface is made higher than a potential of an electrode to which electrons are emitted (a potential of a dynode itself). Further, in this instance, an output gain obtained by the photomultiplier tube 1 is 4.47 times greater than the comparative example, which results in a fact that a secondary electron multiplying rate is higher by about 13% on average.

Figure 9:
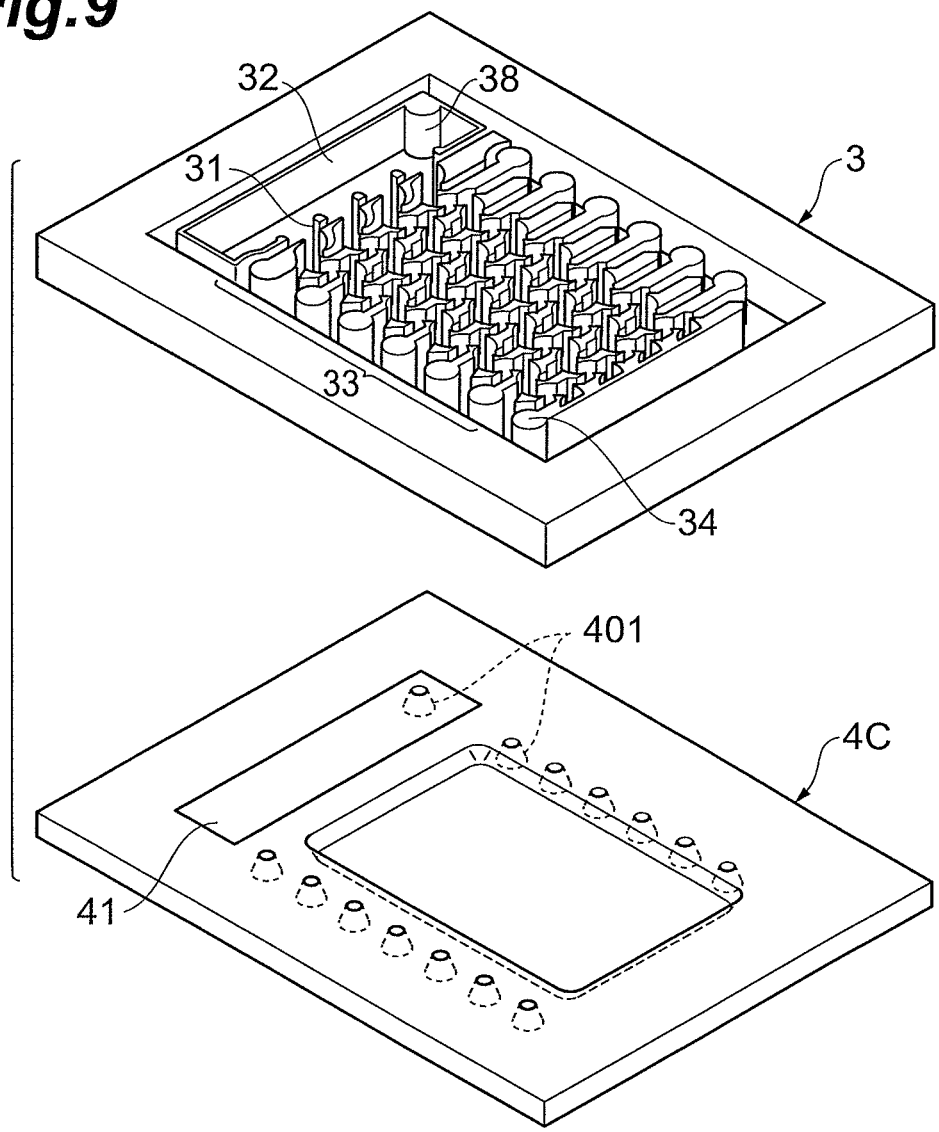
FIG. 9 is an exploded perspective view which shows a photomultiplier tube related to a modified example of the present invention.

It is noted that the present invention shall not be limited to the embodiments so far described. For example, various modes can be adopted for the wiring structure of the present embodiment. For example, as shown in FIG. 9, such a structure may be provided that conductive terminals 401 are formed so as to penetrate through the lower frame 4C, and power is supplied via the conductive terminals 401 to the photocathode 41, the wall-like electrode 32, the focusing electrodes 31, the electron multiplying parts 33 and the anode part 34. This structure makes it possible to supply power independently to the conductive layers 202 (FIG. 6(*a*)) formed on the upper frame 2 and each of the electrodes.

Figure 10:
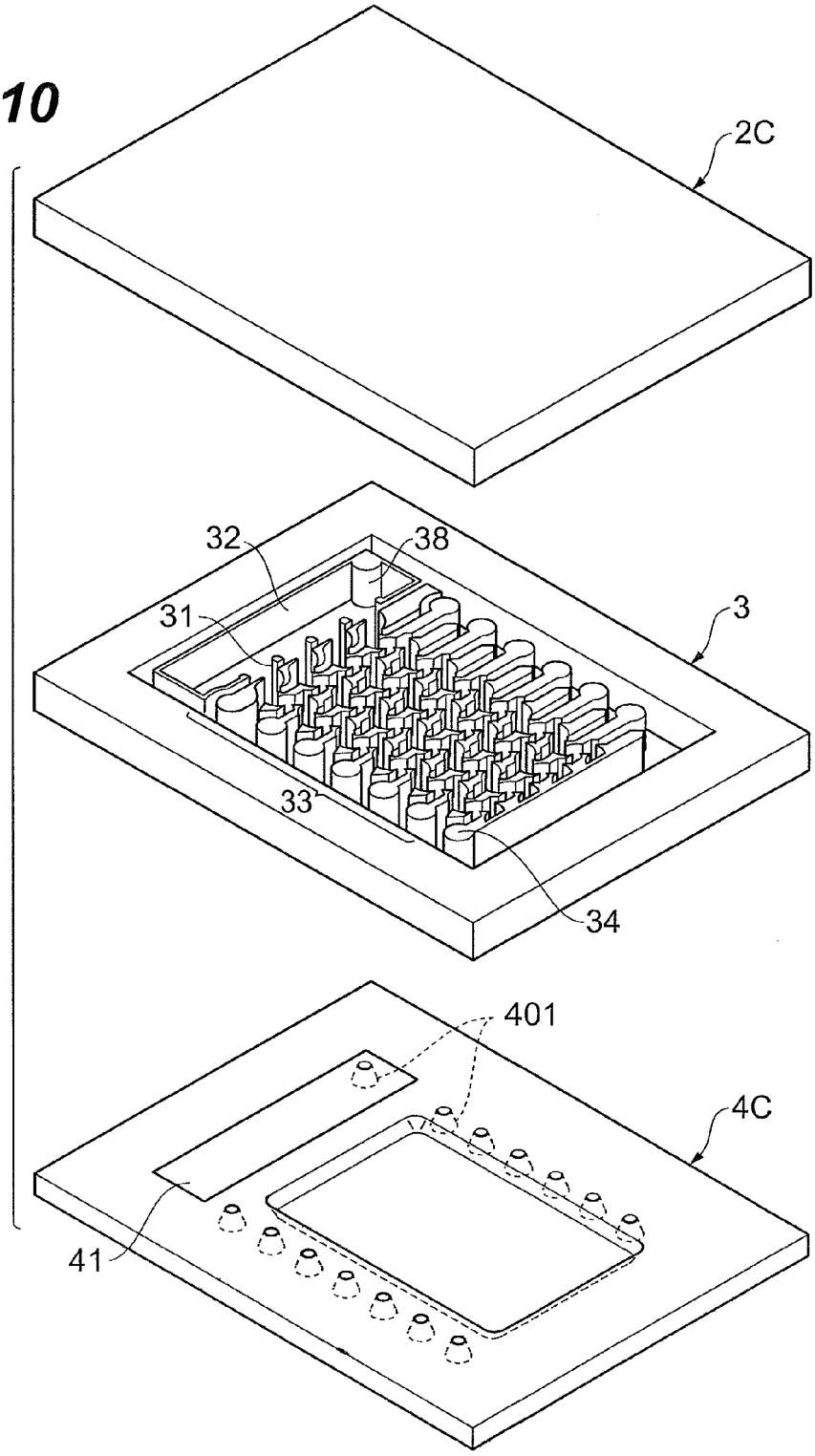
FIG. 10 is an exploded perspective view which shows a photomultiplier tube related to a modified example of the present invention.

Further, as shown in FIG. 10, the lower frame 4C having the conductive terminals 401 may be combined with the upper frame 2C excluding the conductive terminals 201A to 201D. In this instance, as the upper frame 2C, an insulating substrate having a plurality of conductive layers 202 on the back surface side is used. In this combination, the wiring structure described by referring to FIG. 6 is used, thereby making it possible to supply power from the conductive terminals 401 of the lower frame 4C to the conductive layers 202 of the upper frame 2C via the wall-like electrode 32, the electron multiplying parts 33 and the anode part 34.

What is claimed is:

1. A photomultiplier tube comprising:

a housing having a substrate in which at least an inner surface is formed with an insulating material;

an electron multiplying part having N stages (N denotes an integer of two or more) of dynodes arrayed so as to be spaced away sequentially along one direction from a first end side on the inner surface of the housing to a second end side;

a photocathode which is installed on the first end side inside the housing so as to be spaced away from the electron multiplying part, converting incident light from outside to photoelectrons to emit the photoelectrons; and an anode part which is installed on the second end side inside the housing so as to be spaced away from the electron multiplying part to take out electrons multiplied by the electron multiplying part as a signal, wherein each of the N stages of dynodes is arranged on the inner surface, provided with a plurality of columnar parts where secondary electron emitting surfaces are formed, thereby forming electron multiplying channels having the secondary electron emitting surfaces between adjacent columnar parts among the plurality of columnar parts, and a first recessed surface which opposes the columnar part of an $M^{th}$ stage dynode at the columnar part of an $M+1^{th}$ stage (M denotes an integer of one or more but less than N) dynode is formed in such a manner that first and second end edges of the first recessed surface in a direction along the inner surface project to the first end side from a location on the first recessed surface opposing an end edge of the second end side on the secondary electron emitting surface at the columnar part of the $M^{th}$ stage dynode.

2. The photomultiplier tube according to claim 1, wherein a second recessed surface which opposes the columnar part of the $M+1^{th}$ stage dynode at the columnar part of the $M^{th}$ stage dynode is formed in such a manner that a location on the second recessed surface opposing the first end edge of the $M+1^{th}$ stage dynode is recessed to the first end side.

3. The photomultiplier tube according to claim 1, wherein each of the N stages of dynodes is provided with a base part which is formed at end parts on the inner surface side at the plurality of columnar parts to electrically connect the plurality of columnar parts, and the base part of the $M^{th}$ stage dynode is formed at a location corresponding to the second end edge of the columnar part of the $M+1^{th}$ dynode so as to be recessed to the first end side.

4. The photomultiplier tube according to claim 1, wherein the anode part is provided with an electron trapping part which is formed in such a manner as to be recessed to the second end side opposite to the electron multiplying channel of the $N^{th}$ stage dynode.

* * * * *